United States Patent [19]

Winter et al.

[11] 4,281,435

[45] Aug. 4, 1981

[54] SLIDING DOOR CLOSET

[75] Inventors: Claus Winter, Hamburg; Wolfgang Ehrmann, Ruppichteroth, both of Fed. Rep. of Germany

[73] Assignee: Inbauproduct Innenausbausysteme GmbH & Co. KG, Hamburg, Fed. Rep. of Germany

[21] Appl. No.: 83,856

[22] Filed: Oct. 11, 1979

[30] Foreign Application Priority Data

Oct. 12, 1978 [DE] Fed. Rep. of Germany ..... 2844396

[51] Int. Cl.[3] ..... A47N 1/04; A47N 15/00

[52] U.S. Cl. ..... 16/94 R; 16/96 R

[58] Field of Search ..... 16/94 R, 94 D, 95 R, 16/96 R, 87 B, 86.2, 102, 98, DIG. 31, DIG. 20

[56] References Cited

U.S. PATENT DOCUMENTS 4,166,306 9/1979 Janson ..... 16/94 R

FOREIGN PATENT DOCUMENTS 474246 8/1969 Switzerland ..... 16/94 R 1252891 11/1971 United Kingdom ..... 16/94 R

*Primary Examiner*—Wayne L. Shedd

[57] ABSTRACT

Apparatus for hanging sliding doors of a closet include upper and lower track members each of which has a rear wall and guide rails for guidingly supporting the rollers of at least two sliding doors. At least one longitudinally extending groove is formed in each track member and is accessible through the rear wall. A threaded nut is positioned non-rotatably but displaceable lengthwise within each groove. A bracket having a pair of mutually substantially perpendicularly extending legs is connected to each track member by one of its legs. The other leg of each bracket has at least one hole formed therein for reception of a fastening element so that such other leg can be connected to a selected vertical wall of the closet. A threaded fastening element is insertable through the one bracket leg into the groove and is threadedly cooperable with the threaded nut to connect the bracket to the track member.

9 Claims, 2 Drawing Figures

SLIDING DOOR CLOSET

BACKGROUND OF THE INVENTION

The invention relates to a sliding door closet where the open front side is covered by at least two sliding doors, which are hung and supported, respectively, by means of rollers on guide rails of upper and lower tracks.

In sliding door closets when the sliding doors are disposed in front of the closet body, difficulties arise in accommodating the tracks. The upper track in such instances is fastened on the top side of the closet. In the case of a built-in closet, therefore, the side walls and the dividing walls cannot be extended up to the ceiling.

It is the principal object of the invention to provide a sliding door closet of the above mentioned kind such that the sliding doors to be disposed in front of the closet body can terminate almost at the same level as the side walls and dividing walls of the closet body and to simplify accommodation of the track members on the closet body.

SUMMARY OF THE INVENTION

According to the invention the track members are connected as an upper terminal fitting and as a lower base member to the closet body. Each track has at least one longitudinal groove which is open toward its rear and is T-shaped in cross-section. Fastening nuts are guided non-rotationally but displaceably lengthwise within the grooves. Brackets are attached to the fastening nuts by means of screws and the free legs of the brackets are secured by means of screws in selected holes of vertical rows of holes which are formed in the side walls or in the dividing walls of the closet body in the region of its open front.

With this arrangement and design of the tracks it is possible to dispose the sliding doors so that they terminate almost at the same level in front of the closet body. Attachment of the tracks with the brackets at the closet body is simple, it being possible to bring the brackets into the positions adjacent the side walls and dividing walls of the closet body by lateral displacement of the fastening nuts within the longitudinal grooves before tightening the screws. Forming the rows of holes in the side walls and dividing walls of the closet body causes no difficulties and, in fact, modular furniture already exists which provides such rows of holes. Also, the connecting brackets which can be used have already been in use in the furniture trade.

In order that the fastening nuts can receive the screws within the longitudinal grooves a widened part of the groove is deeper than the diameter of the nuts. Due to the provision of webs in this widened part of the groove the nuts are retained non-displaceably in the axial direction of the screws and in contact at the narrowed insertion slit of the groove. The ends of the screws projecting from the nuts have space enough in the widened part of the groove.

The structural height of the track can be kept small due to the fact that the track has an E-shaped cross section and that the longitudinal groove is formed in the central web of the track members. This is important in order that the sliding doors can be brought as close as possible to the open front of the closet body.

The same purpose is achieved in that an outer web and the central web of the track are given guide rails which extend at right angles to the same side, and that these guide rails are arranged in a plane that is parallel to the rear side of the track.

To facilitate the hanging of the sliding doors in a built-in sliding door closet at least the upper track is fastened at a small distance from the upper edge of the side walls or dividing walls.

According to a preferred embodiment the tracks can be manufactured cheaply due to the fact that the tracks with the longitudinal grooves therein are formed as a unitary member.

In order that the tracks can be applied flush with the open front of the closet body the brackets should have, in a manner known per se, holes along the center line axes of their legs and open slits or recesses at their lateral and front edges, the opposed slits or recesses of parallel edges being spaced to enable alignment with the holes in the side or dividing walls of the closet. The legs of the brackets are thus connectable with the closet body and the spacing of the slits or recesses is fixed so that the outer sides of the legs are connectable with the tracks so as to terminate flush with the front faces of the side walls or dividing walls of the closet body.

The invention will be explained in greater detail with reference to an embodiment illustrated in the drawings.

DESCRIPTION OF THE PREFERRED EMBODIMENT

Figure 1:
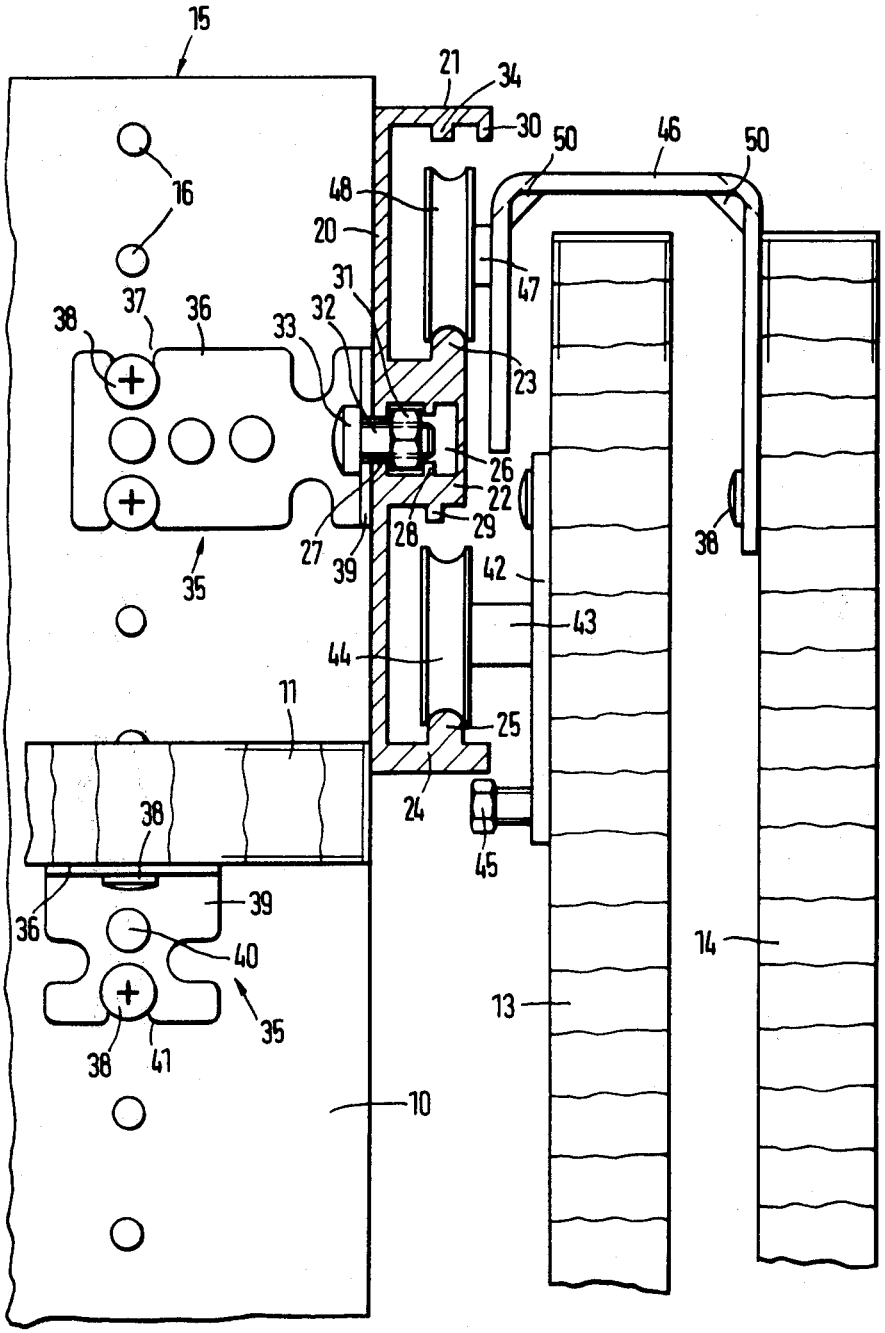
FIG. 1 is a fragmentary side elevational view of the upper portion of a closet showing the attachment of the upper track to the closet body and the suspension of the tops of the sliding doors.
Figure 2:
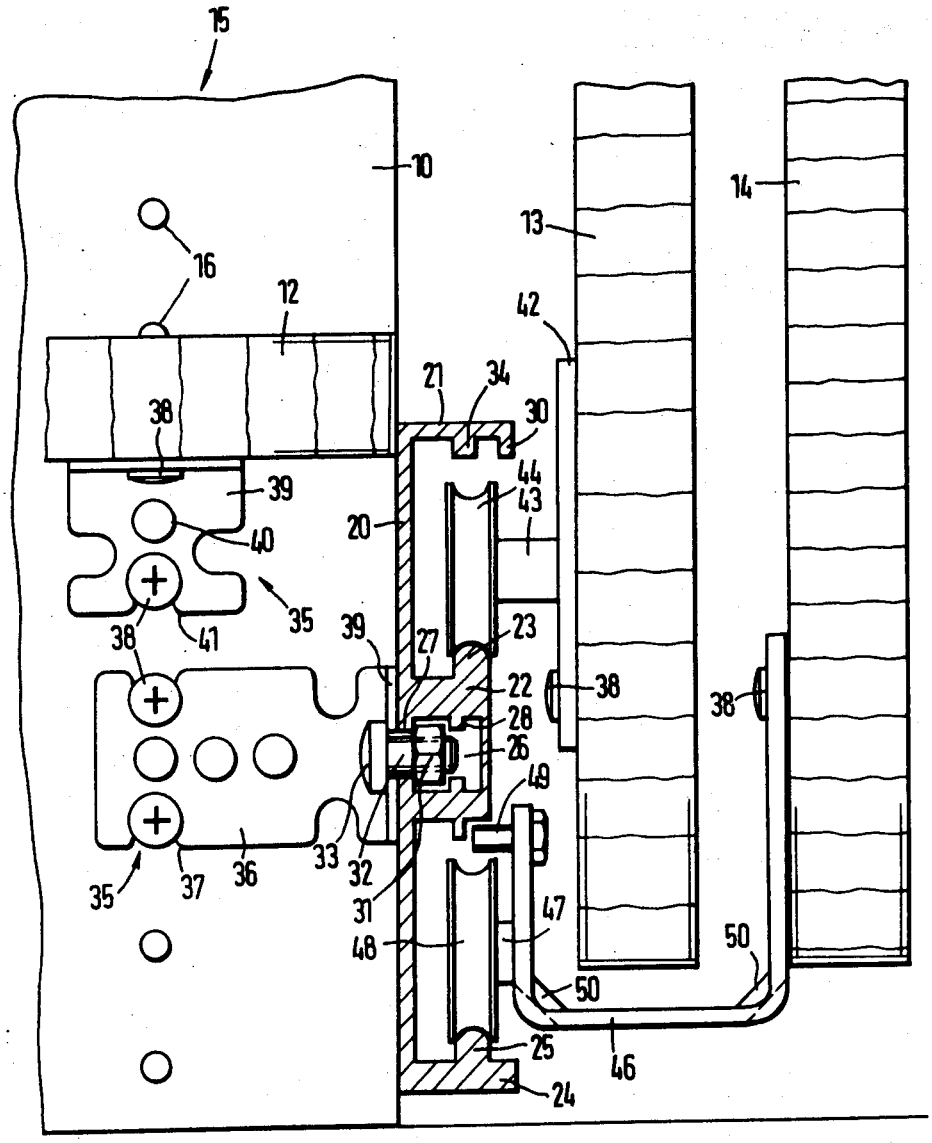
FIG. 2 is a view similar to that of FIG. 1 showing the attachment of the lower track to the closet body and the support of the bottom of the sliding doors.

FIGS. 1 and 2 do not illustrate the entire closet body, but depict only a dividing wall 10, an upper cover plate 11, and a lower bottom plate 12. Dividing wall 10 rests on the floor and may, in the case of a built-in closet, extend upwardly to the ceiling at its upper extremity.

All side walls and and other dividing walls are of equal height and, spaced from the front vertical end face are provided with a vertical of holes 15. This row of holes may be disposed on one or on both sides.

Referring to FIGS. 1 and 2, it will be seen that the cover plate 11 and the bottom plate 12 are connected with the dividing wall 10 by means of brackets 35 which are known in the furniture art and are thus commercially available. The cover plate 11 and the bottom plate 12 are also preferably provided with rows of holes. The brackets 35 have a long leg 36 and short leg 39. The center line axes of these legs 36 and 39 are provided with holes 40. The spacing of the holes at least in legs 39 are matched to the spacing of the holes 16 in the rows 15. The lateral and front edges of the legs 36 and 39 have open slits or recesses 37, 41, the opposed slits of parallel edges being likewise matched to the spacing of the holes 16 in the rows 15. In this way it is possible to connect the cover plate 11 and the bottom plate 12 to the dividing wall by means of screws 38, it being possible in either event to utilize a bore 16 of a perforation row 15.

The tracks 20, designed as sections of a metal sectional shape, have lengths matched to the width of the sliding door closet. The cross section of the tracks 20 is E-shaped, the outer webs or flanges 21 and 24 and the middle web 22 defining two chambers for the reception of rollers. The middle web 22 is deeper and is provided with a Y-shaped longitudinal groove 26 open toward the rear of track 20. The widened part of groove 26 is deeper than the height of diameter of the fastening nuts 31, which are guided non-rotationally but displaceably lengthwise in the groove 26. In the widened part of groove 26, opposite webs or flanges 28 are integrally formed with the middle web 22 and serve to retain the fastening nuts 31 undisplaceably in the screwing direction of screws 32 threadable therein while holding them in contact at the narrowed insertion slot 27. The screws 32 can then be screwed through the fastening nuts 31 and the ends of such screws have enough space in the widened region behind the webs 28. Screws 32, which have an enlarged secure head 33, secure the short legs 39 of additional brackets 35 to the track 20. As long as the screws 32 are not tightened, the bracket 35 with its fastening nut 31 can be displaced lengthwise along the groove 26 and can thus be adjusted to the correct position so that the long leg 39 can be screwed to the dividing wall 10 or a side wall by means of screws 38. For such attachment the holes 16 of the row 15 can be utilized.

The upper track 20, as FIG. 1 shows, is fastened to the closet body as upper terminal fitting, the outer web 21 being locatable a small distance from the upper edges of the dividing wall 10 and the side walls. The sliding doors 13 and 14 can thus be hung even if the closet body reaches to the ceiling of the room.

The lower track 20, of the same design as the upper track 20, is fastened to the closet body as a base member as shown in FIG. 2. The outer web 24 may again be arranged at a small distance from the floor.

Attachment to the dividing wall 10 and the side walls is effected in the same manner as described with respect to the upper track by means of brackets 35, screws 32 and fastening nuts 31. The lower outer web 24 and central web 22 of the upper and lower tracks carry guide rails 23 and 25 which extend perpendicularly and whose contours are matched to the grooves of the rollers 44 and 48. The guide rails 23 and 25 are directed upwardly and lie in a plane parallel to the rear of track 20.

At the central web 22 and at the outer web 21 respectively fastening webs 29 and 34 are integrally formed, to which stop elements for limiting the movements of the sliding doors 13 and 14 may be fastened. Web 30 on the outer web 21 forms the outer extremity of track 20. The inner sliding door 13 is provided adjacent its upper and lower edges with top and bottom fastening plates 42, secured by screws 38. Bearing pins 43 extend from these fastening plates 42 and rotatably mount rollers 44. At least two rollers 44 per inner sliding door 13 are hung at the guide rail 25 of the upper track 20 and at least two rollers 44 per inner sliding door 13 are supported on the guide rail 23 of the lower track 20. Screw 45, which is screwed into a threaded bore of the upper fastening plate 42, prevents the hung and supported sliding door 13 from becoming unhung. This screw 45 must be removed before the sliding door 13 can be unhung.

The outer sliding door 14 is provided at the top and bottom thereof with at least two fastening straps 46, which engage over the upper and bottom edges respectively of the inner sliding door 13. The rollers 48 mounted rotatably on the bearing pins 47 provide for the displaceability of the sliding door 14. Each outer sliding door 14 is hung over at least two fastening straps 46 with rollers 48 at the upper guide rail 23 of the upper track 20 and are supported over at least two fastening straps 46 with rollers 48 at the lower guide rail 25 of the lower track 20. Screw 49, screwed into the lower fastening strap 46, prevents the hung sliding door 14 from becoming unhung, because the door strikes against the central web 22 of the lower track 20. This screw 49 must be removed before the sliding door 14 can be unhung.

For a wide sliding door closet the length of the tracks 20 is correspondingly increased so that it is possible to hang several sliding doors 13 and 14 in the tracks 20, to support them and to secure them against becoming unhung. All sliding doors lie in front of the closet body and the fittings do not add much to the thickness. The sliding doors can be installed practically flush with the top and bottom sides of the sliding door closet.

The fastening straps 46 may be stiffened at the corners by a reinforcing seam to achieve adequate stability with a relatively small thickness.

We claim:

1. Apparatus for hanging the sliding doors of a closet comprising:

upper and lower track members each of which includes a rear wall and guide rail means for guidingly supporting the rollers of at least two sliding doors;

at least one longitudinally extending groove in each of said track members accessible through said rear wall thereof;

a threaded nut positioned non-rotatably but displaceable lengthwise within each said groove;

a bracket comprising a pair of mutually substantially perpendicularly extending legs connected to each of said track members by one of said legs, the other leg of each said bracket having at least one hole formed therein for reception of fastening means to secure said other leg to a selected vertical wall of the closet;

and threaded fastening means insertable through said one leg of each said bracket into said groove and threadedly cooperable with one of said nuts for connecting said one leg of each bracket with one of said track members.

2. Apparatus according to claim 1, wherein each said track member is generally E-shaped and comprises upper and lower outer flanges and a middle web, said longitudinally extending groove being formed in said middle web.

3. Apparatus according to claim 2, wherein said guide rail means are formed on said middle web and on said lower flange, said guide rail means extending upwardly in generally parallel relation to said rear wall.

4. Apparatus according to claims 1, 2, or 3, wherein said longitudinally extending groove is generally T-shaped and includes a slot in said rear wall and a relatively deeper portion within said middle web, said deeper portion being of greater dimension than flats formed on the outer surface of said nut but of lesser dimension than other portions of the outer surface of said nut to thereby prevent rotation of the nut.

5. Apparatus according to claim 3, wherein said threaded fastening means includes a shank portion insertable through said slot, said shank being threaded for cooperation with said nut.

6. Apparatus according to claims 1, 2 or 3, including a pair of longitudinally extending retaining flanges formed integrally with said middle web and projecting into said longitudinally extending groove from opposed sides of said middle web, said retaining flanges serving to limit axial movement of the nut within the groove.

7. Apparatus according to claim 1, wherein said track members are each formed as one-piece members.

8. Apparatus according to claim 1, wherein at least said other leg of said brackets is provided with a plurality of holes along the longitudinal center line thereof and with recesses in the parallel edges thereof, the spacing between said recesses being selected to correspond with the spacing between the holes in a vertical series of holes formed in the vertical wall of the closet to which the brackets are to be attached.

9. Apparatus according to claim 8, wherein the spacing between said recesses in said other bracket leg is selected such that the outer sides of said one legs of the brackets terminate flush with the end faces of the vertical wall of the closet.

* * * * *